US005456059A

United States Patent [19]

Limousin

[11] Patent Number: 5,456,059

[45] Date of Patent: Oct. 10, 1995

[54] PACKAGE AND APPARATUS FOR MAKING

[75] Inventor: Jean L. Limousin, Clearwater, Fla.

[73] Assignee: Automation Packaging, Inc., Tampa, Fla.

[21] Appl. No.: 364,856

[22] Filed: Dec. 27, 1994

Related U.S. Application Data

[62] Division of Ser. No. 33,146, Mar. 16, 1993, Pat. No. 5,414,978.

[51] Int. Cl.[6] ..... B65B 51/00; B65B 53/02

[52] U.S. Cl. ..... 53/492; 53/375.9; 53/381.1; 53/254; 53/463; 53/557

[58] Field of Search ..... 53/463, 461, 477, 53/475, 375.9, 442, 557, 492, 381.1, 254, 532, 212, 211, 210, 284.7; 206/497, 445, 303, 0.8, 0.82

[56] References Cited

U.S. PATENT DOCUMENTS

| | | | |
|---|---|---|---|
| 1,653,908 | 12/1927 | Hunt . | |
| 1,988,307 | 1/1935 | Fay | 206/445 X |
| 2,556,214 | 6/1951 | Pottle . | |
| 2,590,128 | 3/1952 | Sandberg | 53/463 |
| 2,668,403 | 2/1954 | Rumsey, Jr. | 53/463 X |
| 3,445,056 | 5/1969 | McCollough | 206/0.82 X |
| 3,743,118 | 7/1973 | Fluck . | |
| 3,858,380 | 1/1975 | Schmechel | 53/52 |
| 4,089,459 | 5/1978 | Huard | 206/0.82 X |
| 4,338,768 | 7/1982 | Bauestrazzi | 53/495 |
| 5,076,440 | 12/1991 | Drummond | 206/830 X |

*Primary Examiner*—James F. Coan
*Attorney, Agent, or Firm*—Frijouf, Rust & Pyk

[57] ABSTRACT

An improved machine is disclosed for stacking a plurality of flat objects. The improved machine for stacking is suitable for use with a packaging machine such as a shrink wrap packaging machine for packaging the plurality of flat objects with a heat shrinkable film. An input conveyor individually conveys each of the plurality of flat objects to the stacker. The stacker forms a vertical stack of the flat objects from the plurality of flat objects. The stacker may be used in conjunction with a wrapper to form the heat shrinkable film into a film tube with the vertical stack of flat objects disposed therein. An input oven transport transfers the vertical stack of flat objects to a heat shrink oven to form a heat shrink package thereby. The invention is also incorporated into a shrink wrap package having an electrostatic seal enabling an operator to twist the heat shrink package to fracture the electrostatic seal for removing the stack of flat objects therefrom.

3 Claims, 12 Drawing Sheets

PACKAGE AND APPARATUS FOR MAKING

This application is a division of U.S. application Ser. No. 08/033,146 filed Mar. 16, 1993, now U.S. Pat. No. 5,414, 978, the disclosure of which is incorporated herein by reference.

FIELD OF THE INVENTION

This invention relates to an improved stacker for stacking a plurality of flat objects. The improved stacker is suitable for use with a packaging machine such as a shrink wrap packaging machine. The invention also relates to an improved easy open shrink wrap package for a plurality of flat objects.

BACKGROUND OF THE INVENTION

Various types of packaging machines have been developed in the past for packaging articles of various shapes and sizes. One very popular type of packaging machine is a shrink wrap packaging machine for producing a shrink wrap package from a heat shrunk shrink wrap packaging film.

Shrink wrap packaging has become an extremely popular method of encapsulating a single or plurality of objects. Shrink wrap packages may be used for either an internal packaging or for an external packaging. Typically, a shrink wrap packaging film is formed into a longitudinally extending horizontal film tube. The lateral edges of the shrink wrap packaging film are established in an overlapping relationship and are secured by a longitudinal extending seal. Typically, the longitudinal extending seal is formed by either a static generator or linear heat seat as should be well-known to those skilled in the art.

A heat seal is formed on a leading end of the horizontal film tube and the object or objects are aligned and inserted into the longitudinally extending horizontal film tube. A heat seal is formed on a trailing end of the horizontal film tube forming a loose package with the object or objects being disposed therein. The loose package containing the objects is then passed through a heat shrinking oven to shrink the shrink wrap packaging film to form the completed heat shrink package.

Although a variety of objects have been packaged with packaging machines, many objects have not been packaged by packaging process due to the shape of the object. The problem of the shape of the object is especially significant in a shrink wrap packaging machine. In the past, objects that do not remain in a stable position during the movement into the longitudinally extending horizontal film tube or during the movement into the heat shrinking oven have not been packaged by the shrink wrap packaging process.

One extremely difficult type of object to package is a plurality of flat objects. A plurality of flat objects present a particular problem because flat objects, when placed on end, have essentially no stability in either a longitudinal or a lateral direction. This problem is further complicated when the flat object is embodied in a disk-shaped object such as hamburger patty or the like.

Although some in the prior art have attempted to provide a shrink wrap packaging machine to solve this problem, a suitable solution has heretofore not been provided by the prior art. Accordingly, the packaging of flat objects, such as hamburger patties, fish patties, rice cakes, potato patties is presently a hand operation. Considering the enormous number of these flat objects sold and consumed each day, such a hand operation significantly adds to the cost of the flat object.

Therefore, it is an object of this invention to provide a machine for stacking a plurality of flat objects comprising a first and a second rotatable starwheel for forming a vertical stack of the flat objects from the plurality of flat objects.

Another object of this invention is to provide a machine for stacking a plurality of flat objects to form a vertical stack of the flat objects from the plurality of flat objects with a second transferred flat object supporting a first transferred flat object.

Another object of this invention is to provide a machine for stacking a plurality of flat objects including counting means for counting a preselected number of the plurality of flat objects to form a preselected vertical stack of the flat objects.

Another object of this invention is to provide a machine for stacking a plurality of flat objects including an input conveyor stop for intermittently terminating the movement of me plurality of flat objects on an input conveyor to the starwheels.

Another object of this invention is to provide an improved shrink wrap packaging machine for packaging a plurality of stackable objects which is capable of aligning flat objects or the like within a shrink wrap packaging film in a stacked relationship.

Another object of this invention is to provide an improved shrink wrap packaging machine for packaging a plurality of stackable objects wherein the machine is capable of counting the number of flat objects to insure uniformity of packaging of the plurality of the flat objects.

Another object of this invention is to provide an improved shrink wrap packaging machine for packaging a plurality of stackable objects which is applicable for shrink wrap packaging of flat objects and the like.

Another object of this invention is to provide an improved shrink wrap packaging machine for packaging a plurality of stackable objects wherein the process time through the heat shrink oven is carefully controlled to insure that frozen items such as hamburger patties, fish patties, rice cakes, potato patties are not overly heated to prevent degenerating the flavor of the product.

Another object of this invention is to provide an improved shrink wrap packaging machine for packaging a plurality of stackable objects which is relatively small in size in comparison to conventional shrink wrap packaging machines.

Mother object of this invention is to provide an improved shrink wrap packaging machine for packaging a plurality of stackable objects which is reliable and sanitary for shrink wrap packaging of food products.

Another object of this invention is to provide an improved shrink wrap packaging machine for packaging a plurality of stackable objects which eliminates the need for non-biodegradable wax impregnated cardboard containers.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the mope of the invention. Accordingly other objects in a full understanding of the invention may be had by referring to the summary of the invention, the derailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention is incorporated into a machine for stacking a plurality of flat objects with each of the flat objects having first and second side surfaces and an edge surface means. Each of the flat objects has an aspect ratio whereby the flat object is generally unstable when placed on the edge surface means. The machine for stacking a plurality of flat objects comprises an input conveyor for serially conveying each of the plurality of flat objects on a side surface of each the flat objects. A stacker comprises a first and a second starwheel having first and second central hubs supporting a first and second plurality of radially spaced star projections. A motor means intermittently rotates the first and second starwheels about a first and a second spaced apart parallel axle. The input conveyor serially conveys a first object of the plurality of flat objects between the first and second starwheels for enabling a star projection from each of the first and second starwheels to lift the first flat object upon a first intermittent rotation of the first and second starwheels. The input conveyor serially conveys a second object of the plurality of flat objects between the first and second starwheels for enabling another star projection from each of the first and second starwheels to lift the .second flat object upon a second intermittent rotation of the first and second starwheels and to support the first flat object upon the second flat object for forming a vertical stack of the flat objects from the plurality of flat objects.

Preferably, the input conveyor is disposed in a generally horizontal orientation for individually conveying each of the plurality of flat objects horizontally to the stacker. The machine for stacking includes counting means for counting a preselected number of the plurality of flat objects to form a preselected vertical stack of the flat objects. An input conveyor stop intermittently terminates the movement of the plurality of flat objects on the input conveyor.

The invention is also incorporated into an improved shrink wrap packaging machine for packaging a plurality of flat objects with a heat shrinkable film. The plurality of flat objects individually emanate from an input source with each of the flat objects being disposed on a side face of the flat object. The improved shrink wrap packaging machine comprises an input conveyor for individually conveying each of the plurality of flat objects to a stacker. The stacker forms a vertical stack of the flat objects from the plurality of flat objects. A wrapper transport transfers the vertical slack of flat objects to a wrapper. The wrapper comprises a wrapper tool and a wrapper driver for forming the heat shrinkable film into a film tube with the vertical stack of flat objects disposed therein. The wrapper includes a sealer for sealing a trailing edge of the film tube for encasing the vertical stack of flat objects. An input oven transport transfers the vertical stack of flat objects to a heat shrink oven whereat an oven conveyor moves the vertical stack of flat objects through the heat shrink oven to form a heat shrink package thereby.

In a more specific embodiment of the invention, the input conveyor is disposed in a generally horizontal orientation for individually conveying each of the plurality of flat objects horizontally to the stacker. Preferably, a counting means counts a preselected number of the plurality of flat objects to form a preselected vertical stack of the flat objects. An input conveyor stop intermittently terminates the movement of the plurality of flat objects on the input conveyor.

In one embodiment of the invention, the stacker comprises a plurality of starwheels with each of the starwheels comprising a central hub supporting a plurality of star projections. The star projections individually lifts the flat objects upon an incremental movement of the plurality of starwheels.

Preferably, the wrapper transport is orientated for vertically transferring the vertical stack of flat objects to the wrapper. The wrapper tool is disposed in a vertical orientation for forming the heat shrinkable film into a vertically orientated film tube. The wrapper driver vertically lifts the vertical stack of flat objects through the wrapper tool within the film tube.

In one embodiment of the invention, the oven conveyor includes an oven conveyor for vertically moving the vertical stack of flat objects through the heat shrink oven with the input oven transport horizontally transferring the vertical stack of flat objects to the oven conveyor. An output conveyor discharges the heat shrink package with an output oven transport horizontally transferring the heat shrink package from the oven conveyor to the output conveyor.

The invention is further incorporated into a shrink wrap package for a stack of flat objects. The shrink wrap package comprises a longitudinally extending sheet of heat shrinkable film having a first and a second sheet end and a first and a second sheet edge. The longitudinally extending sheet of heat shrinkable material is formed into a film tube with the first sheet edge overlapping the second sheet edge. The first and second sheet ends are heat sealed for forming a heat shrink package having a first and a second package end. An electrostatic seal seals the first sheet edge to the second sheet edge with the stack of flat objects being encased therein. The electrostatic seal enables an operator to twist the first package end relative to the second package end to fracture the electrostatic seal for removing the stack of flat objects from the heat shrunk package. Preferably, the electrostatic sea/ extends longitudinally between the first package end relative to the second package end.

The foregoing has outlined rather broadly the more pertinent and important features of the present invention in order that the detailed description that follows may be better understood so that the present contribution to the an can be more fully appreciated. Additional features of the invention will be described hereinafter which form the subject of the claims of the invention. It should be appreciated by those skilled in the an that the conception and the specific embodiments disclosed may be readily utilized as a basis for modifying or designing other structures for carrying out the same purpose of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 14 is a left side view of FIG. 14;

FIG. 19 is a left side view of FIG. 19;

FIG. 22 is a left side view of FIG. 22;

Similar reference characters refer to similar parts throughout the several Figures of the drawings.

DETAILED DISCUSSION

Figure 1:
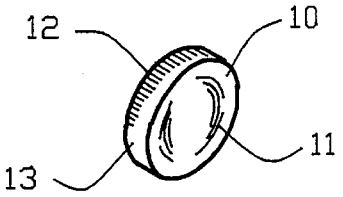
FIG. 1 is an isometric view of a first example of a flat object for wrapping in the shrink wrap packaging machine of the present invention.

FIG. 1 is an isometric view of a first example of a flat object 10 which is to be encased in a heat shrink package of the present invention. For the purposes of this disclosure, a flat object is considered to be an object having first and second side surfaces 11 and 12 and an edge surface means 13 defining an aspect ratio whereby the flat object 10 is generally unstable when placed on the edge surface means 13. In the first example, the flat object 10 is shown as a disc-shaped object such as a frozen hamburger patty or the like. Although a frozen hamburger patty may be placed on the edge surface means 13, vibration and movement of the flat object 10 normally encountered in a shrink wrap packaging machine will generally remit in the flat object 10 falling on either of the first and second side surfaces 11 and 12. The present inventions solves the problem encountered with the heat shrink wrapping of the flat object 10 having the above characteristics.

Figure 2:
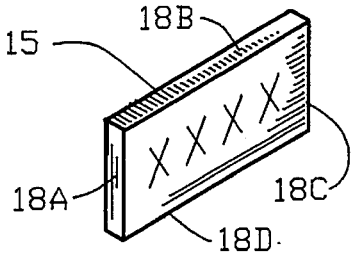
FIG. 2 is an isometric view of a second example of a flat object for wrapping in the shrink wrap packaging machine of the present invention.

FIG. 2 is an isometric view of a second example of a flat object 15 which is to be encased in a heat shrink package of the present invention. In this embodiment, the flat object 15 includes side surfaces 16 and 17 with four edge surfaces 18A–18D. The flat object 15 may be characteristic of a tape cassette or any other suitable object of similar configuration. Although FIGS. 1 and 2 illustrate two examples of a flat object 10 and 15, it should be appreciated by those skilled in the art that numerous types and shapes of flat objects, including food products and non-food products may be embraced as having the characteristics set forth above.

Figure 3:
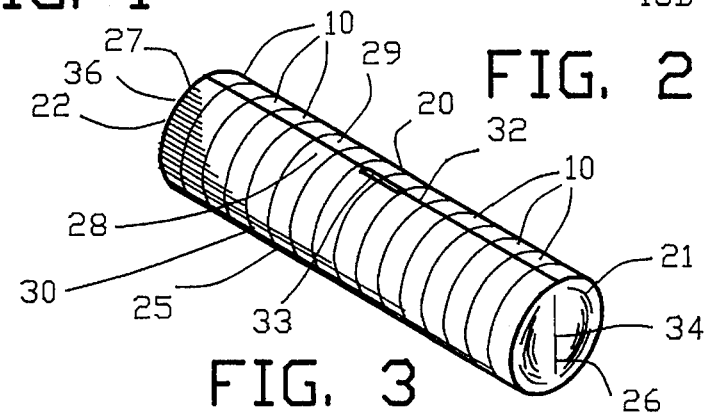
FIG. 3 is an isometric view of an improved easy open shrink wrap package of a plurality of the first example of the flat objects.
Figure 5:
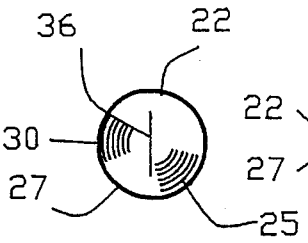
FIG. 5 is a left side view of FIG. 4.
Figure 4:
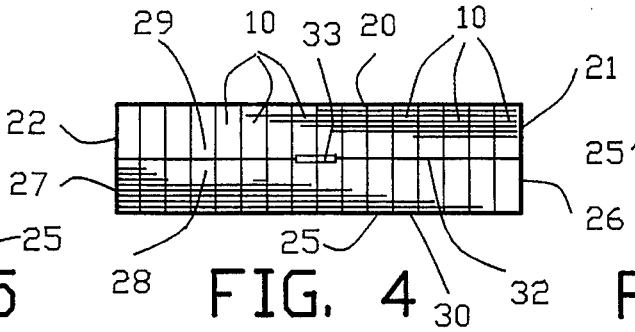
FIG. 4 is a top view of the improved easy open shrink wrap package of FIG. 3.
Figure 6:
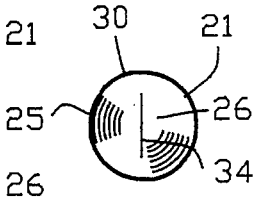
FIG. 6 is a right side view of FIG. 4.

FIG. 3 is an isometric view of a heat shrink package 20 encasing a plurality of the flat objects 10 shown in FIG. 1. The heat shrink package 20 includes a first end 21 and a second end 22. As more fully shown in FIGS. 5–6, the shrink wrap package 20 comprises a longitudinally extending heat shrinkable material 25 having a first and a second end 26 and 27 and a first and a second edge 28 and 29. The heat shrink package 20 is formed into a film tube 30 with the first and second edges 28 and 29 overlapping one another forming a longitudinally extending seam 32. The first and second ends 26 and 27 of the sheet of heat shrinkable material 25 are closed by heat seals 34 and 36 in a conventional manner. The heat shrink package 20 is formed by passing the film tube 30 containing the flat objects through a heat shrink oven to form the heat shrink package shown in FIGS. 3–6. Preferably, the longitudinally extending seam 32 is electrostatically sealed thereby creating a frangible longitudinal seam. The electrostatic seam is created by intermittently electrostatically affixing the first sheet edge 28 to the second sheet edge 29 by an electrostatic generator. An optional heat seal 33 may be interposed within the longitudinally extending seam 32 for additional strength if desired by the user.

Figure 7:
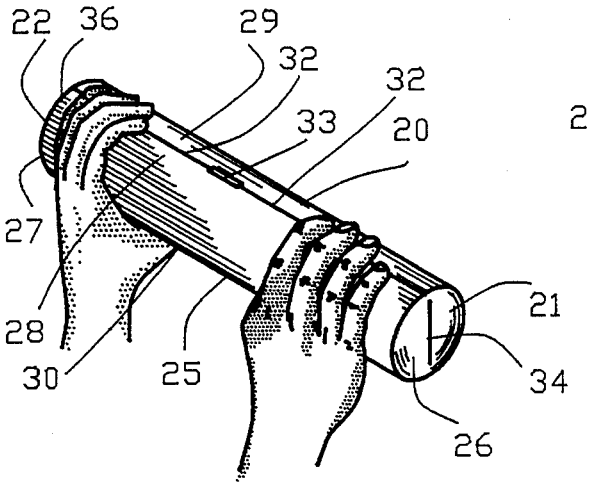
FIG. 7 is an isometric view of the improved easy open shrink wrap package of FIG. 3 with an operator grasping and twisting the package.
Figure 8:
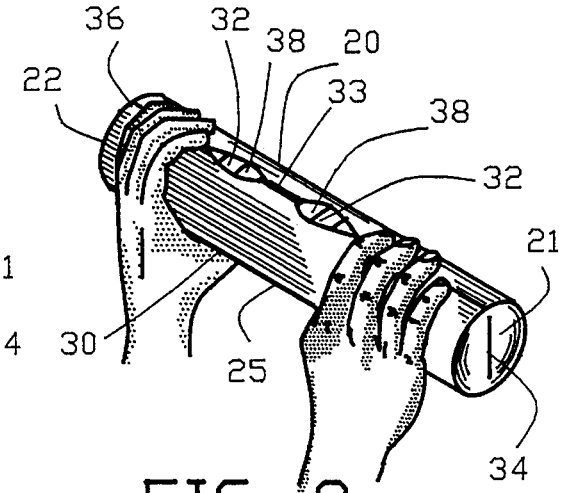
FIG. 8 is an isometric view similar to FIG. 7 illustrating the opening of the improved easy open shrink wrap package.

FIG. 7 illustrates an operator grasping the heat shrink package 20 with a left and a right hand. The heat shrink package 20 of the present invention enables the operator to twist the first end 21 of the heat shrink package 20 relative to the second end 22 of the heat shrink package thereby breaking the frangible seam 32 creating apertures 38. The apertures 38 permit a portion or all of the flat objects 10 to be easily removed from the heat shrink package 20. As it can be apparent from FIG. 8, the flat objects 10 can be readily removed from the apertures 38 of the heat shrink package 20 while the first and second ends 21 and 22 of the heat shrink package 20 retain the flat objects 10 therein. Accordingly, a portion of the flat objects 10 can be removed from the central portion of the heat shrink package 20 with the remainder of the objects 10 remaining in the first and second ends 21 and 22.

The heat shrink package shown in FIGS. 3–8 provides a novel heat shrink package having a frangible seam for removing a portion of a plurality of flat objects 10 therefrom. Although the frangible package operates with various types of flat objects 10, the improved heat shrink package 20 operates in a superior fashion with disc-shaped objects such as perishable, frozen hamburger patties and the like.

FIGS. 9–13 illustrate various views of an improved heat shrink packaging machine 40 for packaging the plurality of the flat objects 10 into the heat shrink package 20 as shown in FIGS. 3–8. The shrink wrap packaging machine 40 comprises a frame 42 for supporting an input conveyor 44 for individually receiving the plurality of flat objects 10 from an external source shown as a chute 46. The plurality of flat objects 10 emanate from the chute 46 with each of the flat objects 10 disposed on one of the first and second side surfaces 11 and 12 in a single file. The input conveyor 44 includes guides 48 and 49 for aligning each of the flat objects 10 into a single file to pass the flat objects 10 to a stacker 50.

Figure 13:
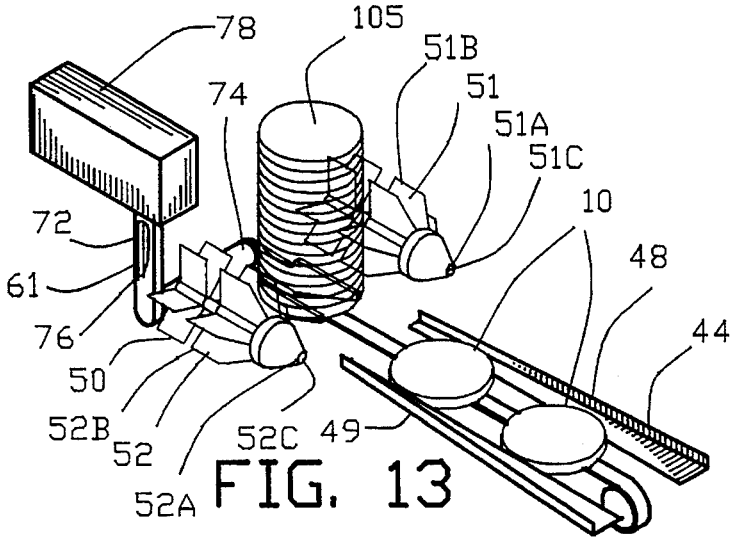
FIG. 13 is an enlarged isometric view of an input conveyor and stacker of the shrink wrap packaging machine of the present invention.

As shown in more detail in FIG. 13, the stacker 50 comprises a plurality of star wheels shown as a first and a second star wheel 51 and 52. The star wheels 51 and 52 comprise central hub 51A and 52A for supporting a plurality of star projections 51B and 52B extending from the central hubs 51A and 51B. The star wheel 51 and 52 are rotatably mounted through axles 51C and 52C extending through the central hubs 51A and 52A. The first and second axles 51C and 52C are mounted in a parallel spaced apart relationship for rotationally supporting the first and second central hubs 51A and 52A of the first and second starwheels 51 and 52. The first and second starwheels 51 and 52 are spaced for enabling the flat object 10 to be received between adjacent star projections 51B and 52B.

Figures 14, 14A:
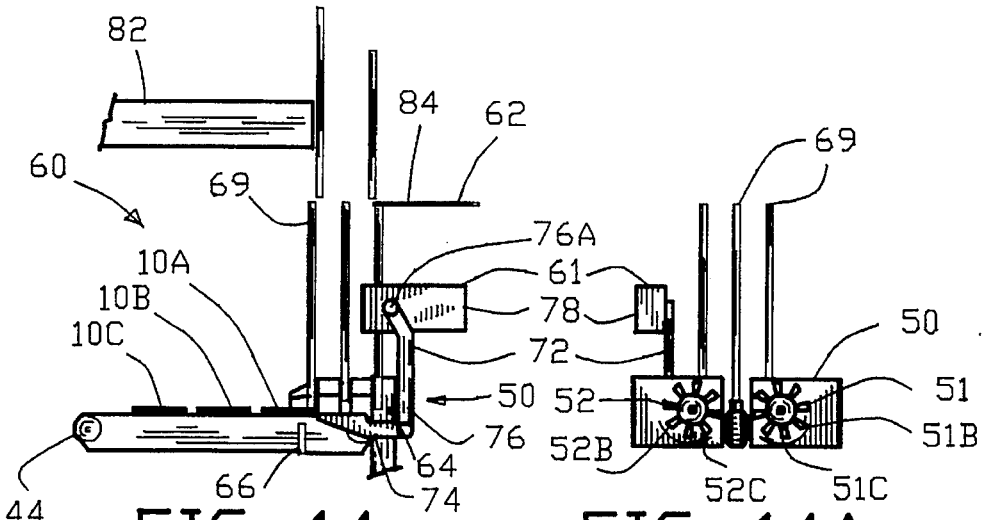
FIG. 14 is an enlarged view of a portion of FIG. 9 illustrating a first flat object being transferred from the input conveyor to the stacker.

FIGS. 14–22 illustrates the sequence of operation of the input conveyor 44, the stacker 50 and a wrapper transport 60 comprising a first and a second wrapper transport 61 and 62. FIG. 14 and 14A illustrate a first, second and a third flat object 10A–10C being transferred by the conveyor 44 toward the stacker 50. Preferably, the conveyor 44 operates continuously for providing maximum throughput of the heat shrink wrapping machine 40.

Figures 15, 15A:
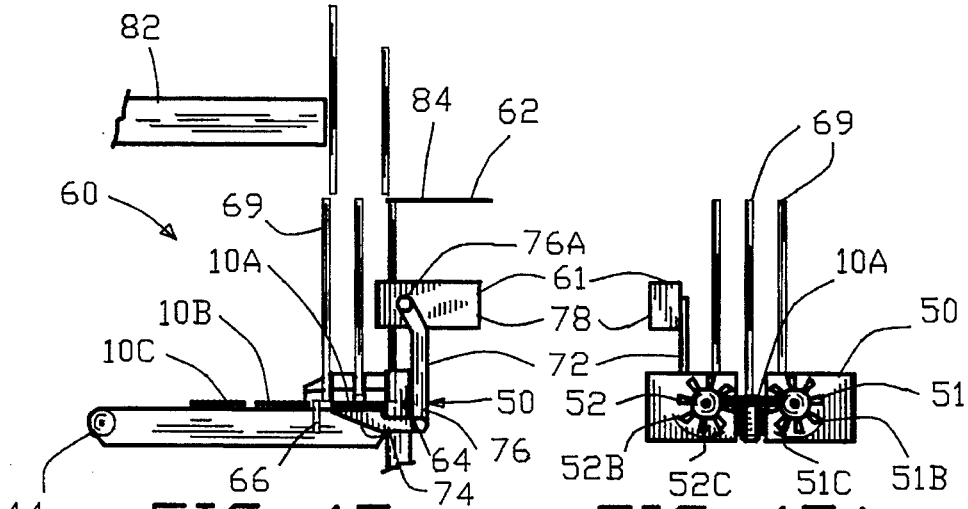
FIG. 15 is a view similar to FIG. 14 illustrating the first flat object disposed in the stacker.
FIG. 15A is a left side view of FIG. 15.

FIG. 15 and 15A illustrate the first flat object 10A being transferred by the conveyor 44 into the stacker 50. When the first flat object 10A is transferred and is properly positioned within a stacker 50, the first flat object 10A triggers a sensor 64 shown in FIG. 9. The sensor 64 is preferably a photoelectric sensor 64 for sensing the presence of a flat object 10 in the proper position within the stacker 50. When the sensor 64 senses the presence of the first flat object 10A in the proper position within the stacker 50, the sensor 64 activates an input conveyor stopper 66. The input conveyor stopper 66 is raised into the path of the input conveyor 44 to terminate the movement of the second and third flat objects 10B and 10C from the input conveyor 44 into the stacker 50.

Figures 16, 16A:
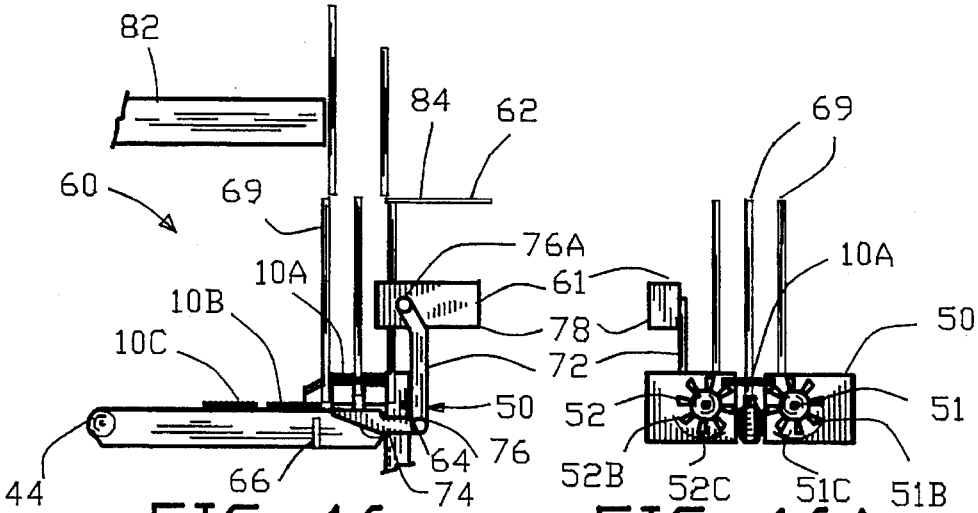
FIG. 16 is a view similar to FIG. 15 illustrating the stacking of the first flat object by the stacker.
FIG. 16A is a left/side view of FIG. 16.

FIG. 16 and 16A illustrate the first flat object 10A being raised by the stacker 50 into an elevated position. Upon the sensor 64 sensing the presence of the first flat object 10A in the proper position within the stacker 50, the sensor 64 activates a motor 68 shown in FIG. 9 to partially rotate the star wheels 51 and 52 for elevating the first flat object 10A by the star projections 51A and 51B. The star projections 51A and 52A support the first flat object 10A in the elevated position enabling the second flat object 10B to be received by the stacker 50. Upon completion of the partial rotation of the star wheels 51 and 52, the input conveyor stopper 66 is lowered from the path of the input conveyor 44 to allow the movement of the second flat object 10B from the input conveyor 44 into the stacker 50.

Figure 17:
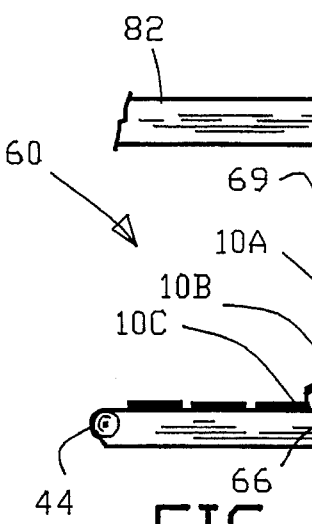
FIG. 17 is a view similar to FIG. 16 illustrating a second flat object disposed in the stacker.
Figure 17A:
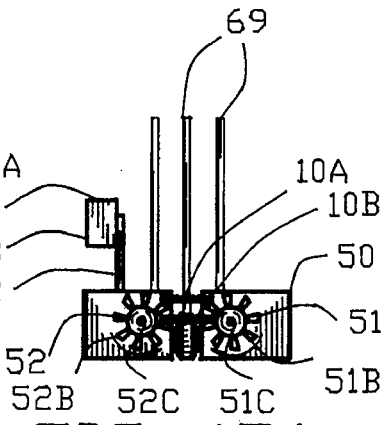
FIG. 17A is a left side view of FIG. 17.

FIG. 17 and 17A illustrate the second flat object 10B being transferred by the conveyor 44 into the stacker 50. When the second flat object 10B is transferred and is properly positioned within the stacker 50, the second flat object 10B triggers the sensor 64 for activating the input conveyor stopper 66 to terminate the movement of the third flat object 10C from the input conveyor 44 into the stacker 50.

Figure 18:
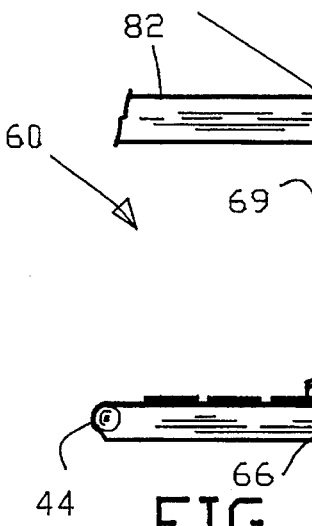
FIG. 18 is a view similar to FIG. 17 illustrating the stacking of the second flat object by the stacker.
Figure 18A:
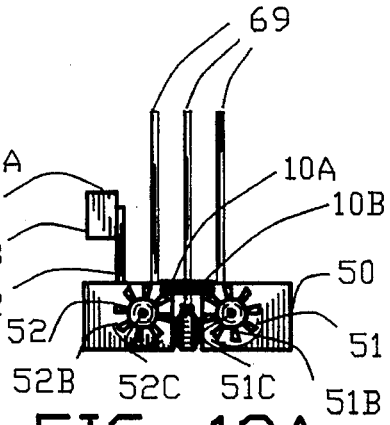
FIG. 18A is a left side view of FIG. 18.

FIG. 18 and 18A illustrate the second flat object 10B being raised by the stacker 50 into an elevated position. Upon the sensor 64 sensing the presence of the second flat object 10B in the proper position within the stacker 50, the motor 68 partially rotates the star wheels 51 and 52 for elevating the second flat object 10B by the star projections 51A and 51B. The second flat object 10B contacts and supports the first flat object 10A with the star projections 51A and 52A supporting both the second flat object 10B and the first flat object 10A in the elevated position. The third flat object 10C may be received by the stacker 50 upon the input conveyor stopper 66 being lowered from the path of the input conveyor 44.

Figure 9:
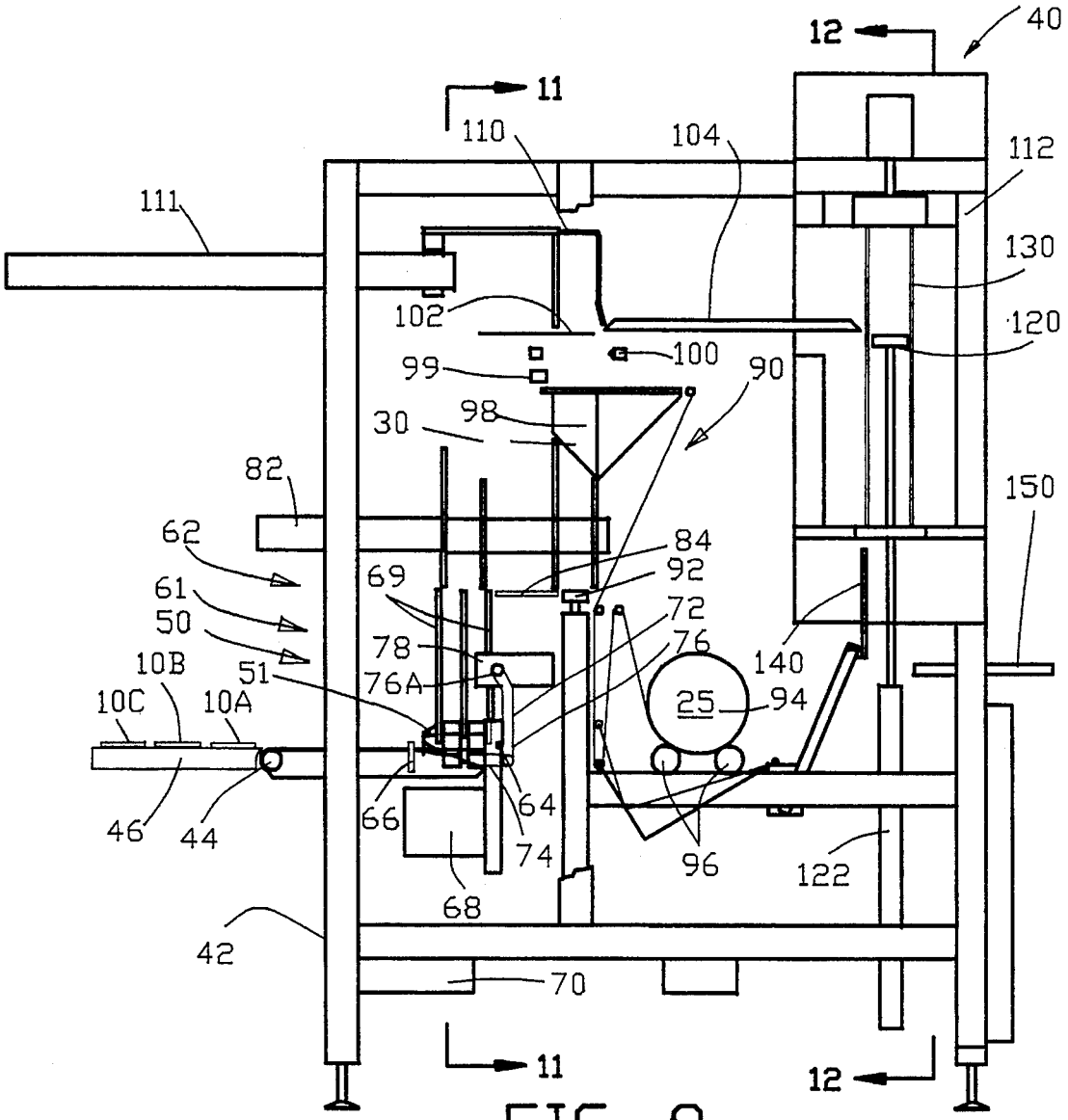
FIG. 9 is a front elevational view of a shrink wrap packaging machine of the present invention.
Figure 10:
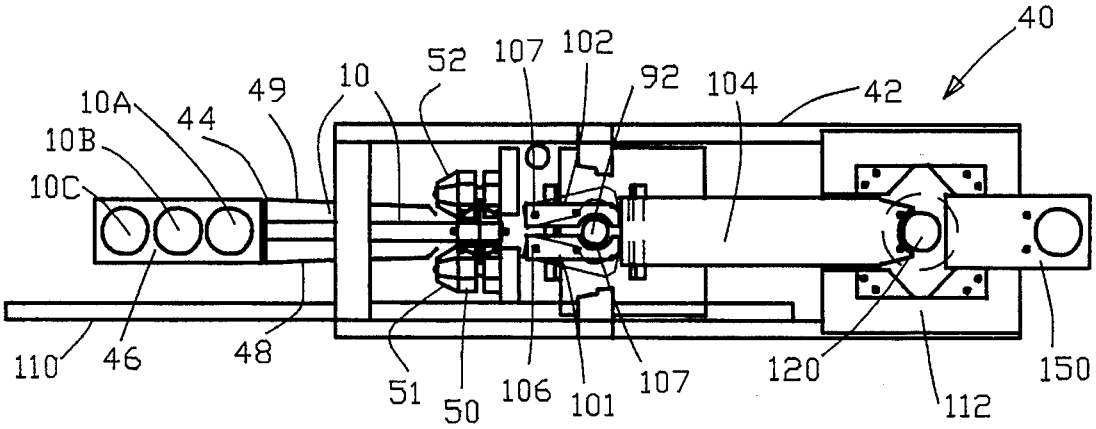
FIG. 10 is a top view of FIG. 9.
Figure 19:
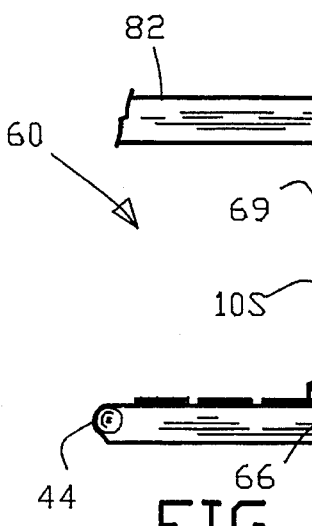
FIG. 19 is a view similar to FIG. 18 illustrating a completed stack of flat objects in the stacker.
Figure 19A:
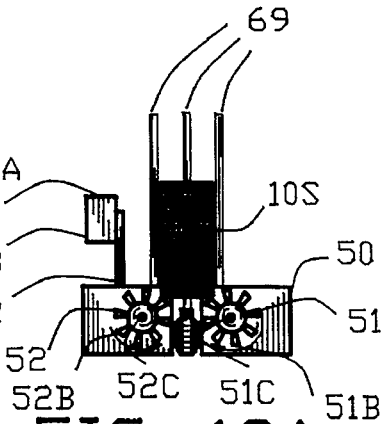

FIG. 19 and 19A illustrate a stack of flat objects 10S being stacked by the stacker 50 into an elevated position. The stack of flat objects 10S are aligned in a uniform stack by alignment rods 69. A counter 70 shown in FIG. 9 is provided for counting a predetermined number of flat objects 10 to form the stack of flat objects 10S for packaging within the heat shrink package 20. When a sufficient number of flat objects 10 has been received and stacked by the stacker 50 to form the stack of flat objects 10S, the counter 70 activates the first wrapper transport 61.

Figure 11:
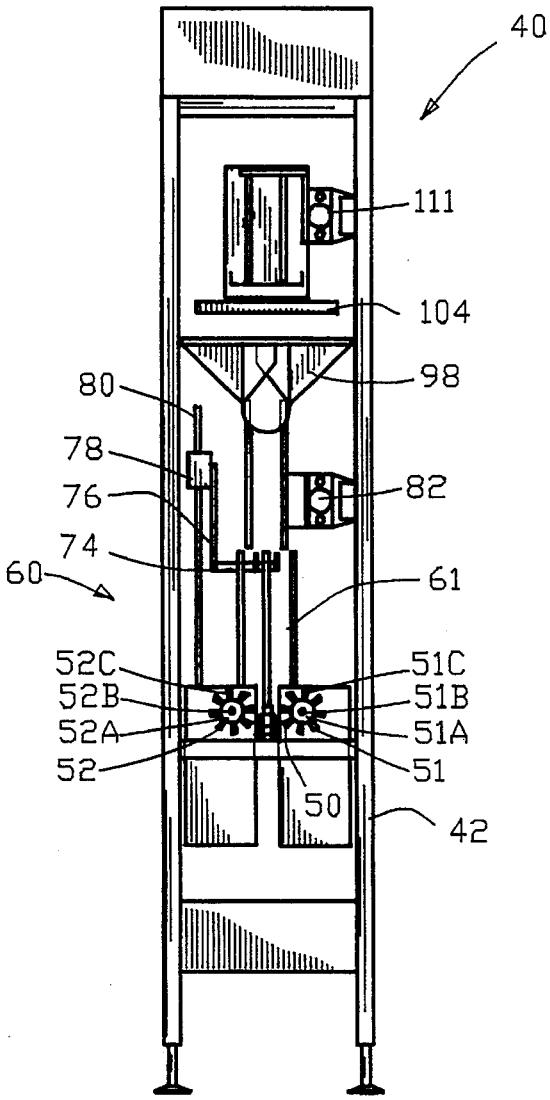
FIG. 11 is a sectional view along line 11—11 in FIG. 9.
Figure 12:
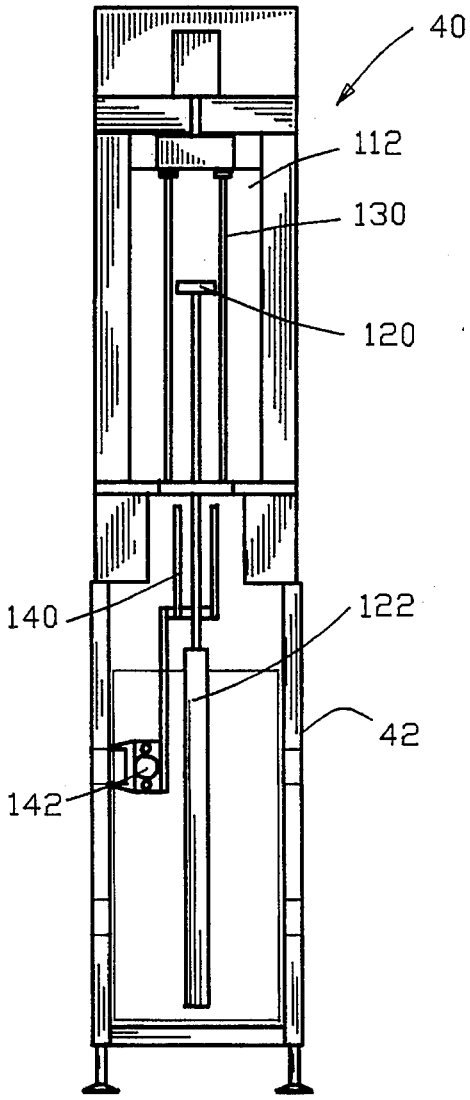
FIG. 12 is a sectional view line 12—12 in FIG. 9.

As best shown in FIGS. 9–13, the first wrapper transport 61 comprises a generally L-shaped elevator 72 having a base 74 connected to an arm 76. The arm 76 is secured to a pivot actuator 78 for pivoting the base 74 and arm 76 about a pivot 76A. FIG. 11 illustrates the pivot actuator 78 being slidably mounted on a rod 80 into an upper position from the lower position shown in FIG. 9.

Figure 20:
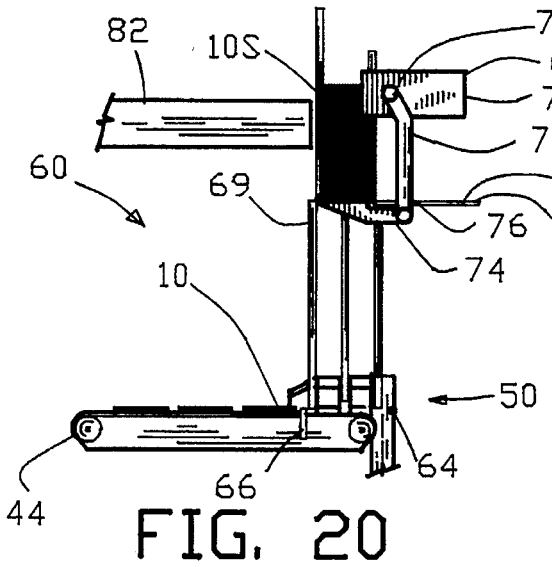
FIG. 20 is a view similar to FIG. 19 illustrating a first stage of transferring the stack of flat objects to a wrapper.
Figure 20A:
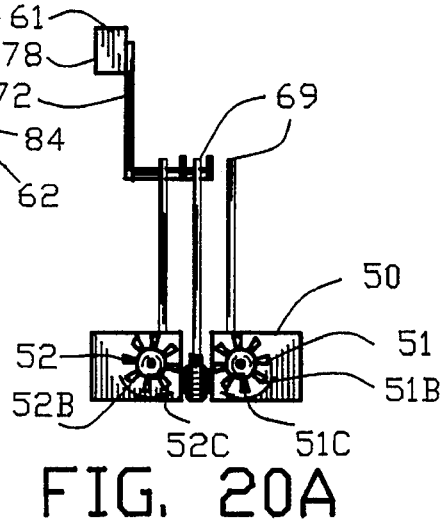
FIG. 20A is a left side view of FIG. 20.

FIG. 20 and 20A illustrate the stack of flat object 10S raised by the first wrapper transport 61 into an elevated position. Upon the counter 70 counting the selected number of flat objects 10 to form the stack of flat object 10S, the counter 70 activates the pivot actuator 78 to move the pivot actuator 76 from the lower position shown in FIG. 19 to the upper position shown in FIG. 20 to raise the stack of flat objects 10S. Preferably, the movement of the pivot actuator 76 is synchronized with the partial rotation of the star wheels 51 and 52 in order to commence movement of the first wrapper transport 61 when the input conveyor stopper 66 is in a raised position for inhibiting the movement of the flat objects 10 from the input conveyor 44 into the stacker 50. This synchronization allows the stacker 50 to operate continuously without interference from the first wrapper transport 61. After the first stack of flat objects 10S is raised by the first wrapper transport 61, the input conveyor stopper 66 is lowered from the path of the input conveyor 44 to allow the movement of the additional flat objects from the input conveyor 44 into the stacker 50. In addition, the counter 70 is again engaged allowing the stacker 50 to count a subsequent stack of flat objects 10 by the star wheels 51 and 52 as described heretofore.

Figure 21:
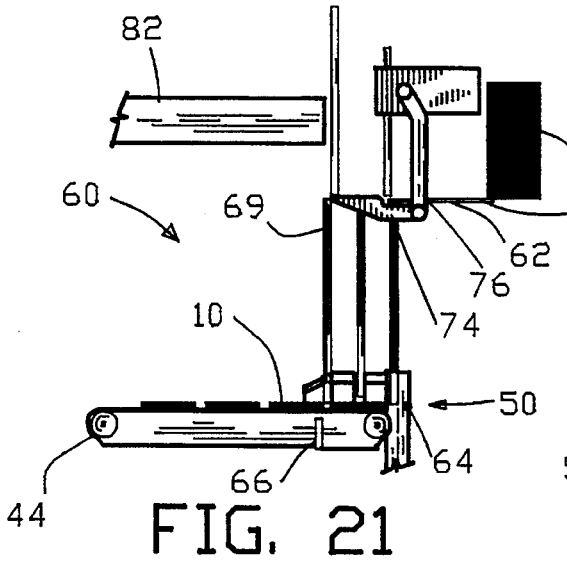
FIG. 21 is a view similar to FIG. 20 illustrating a second stage of transferring the stack of flat object to the wrapper.
Figure 21A:
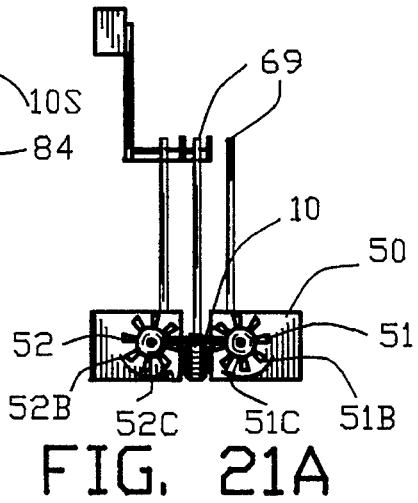
FIG. 21A is a left side view of FIG. 21.

FIG. 21 and 21A illustrate the stack of flat objects 10S being horizontally moved by the second wrapper transport 62. The second wrapper transport comprises a pneumatically operated pusher 82 for pushing the stack of flat objects 10S along a slide 84 to a wrapper 90.

Figure 22:
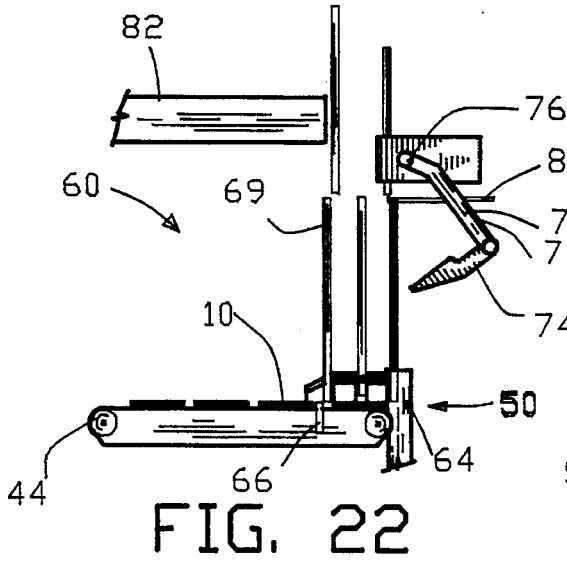
FIG. 22 is a view similar to FIG. 21 illustrating the returning of the first stage to an original position.
Figure 22A:
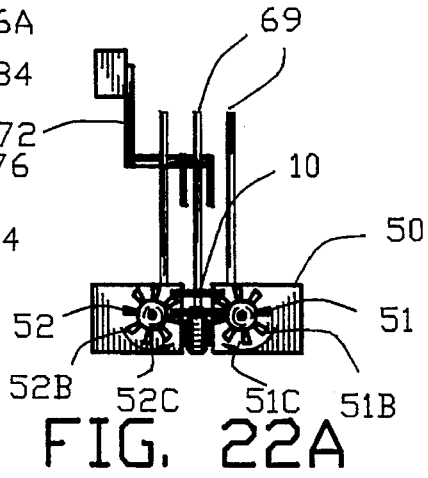

FIG. 22 and 22A illustrate the movement of the pivot actuator 78 to the lower position. Upon the completion of the horizontal movement of the stack of flat objects 10S to the wrapper 90, the pivot actuator 78 pivots the pivoting of the base 74 and arm 76 about the pivot 76A to the position as shown in FIG. 22. Thereafter, the pivot actuator 78 vertically moves along the rod 80 from the upper position as shown in FIG. 22 to the lower position as shown in FIGS. 14–19. Upon the pivot actuator 78 vertically moving to the lower position, the pivot actuator 78 pivots the base 74 and the arm into the position shown in FIGS. 14–19 for lifting a subsequent stack of flat objects 10. The pivoting of the base 74 and arm 76 about the pivot 76A to the position as shown in FIG. 22 allows the stacker 50 to operate continuously without interference from the first wrapper transport 61.

Figure 23:
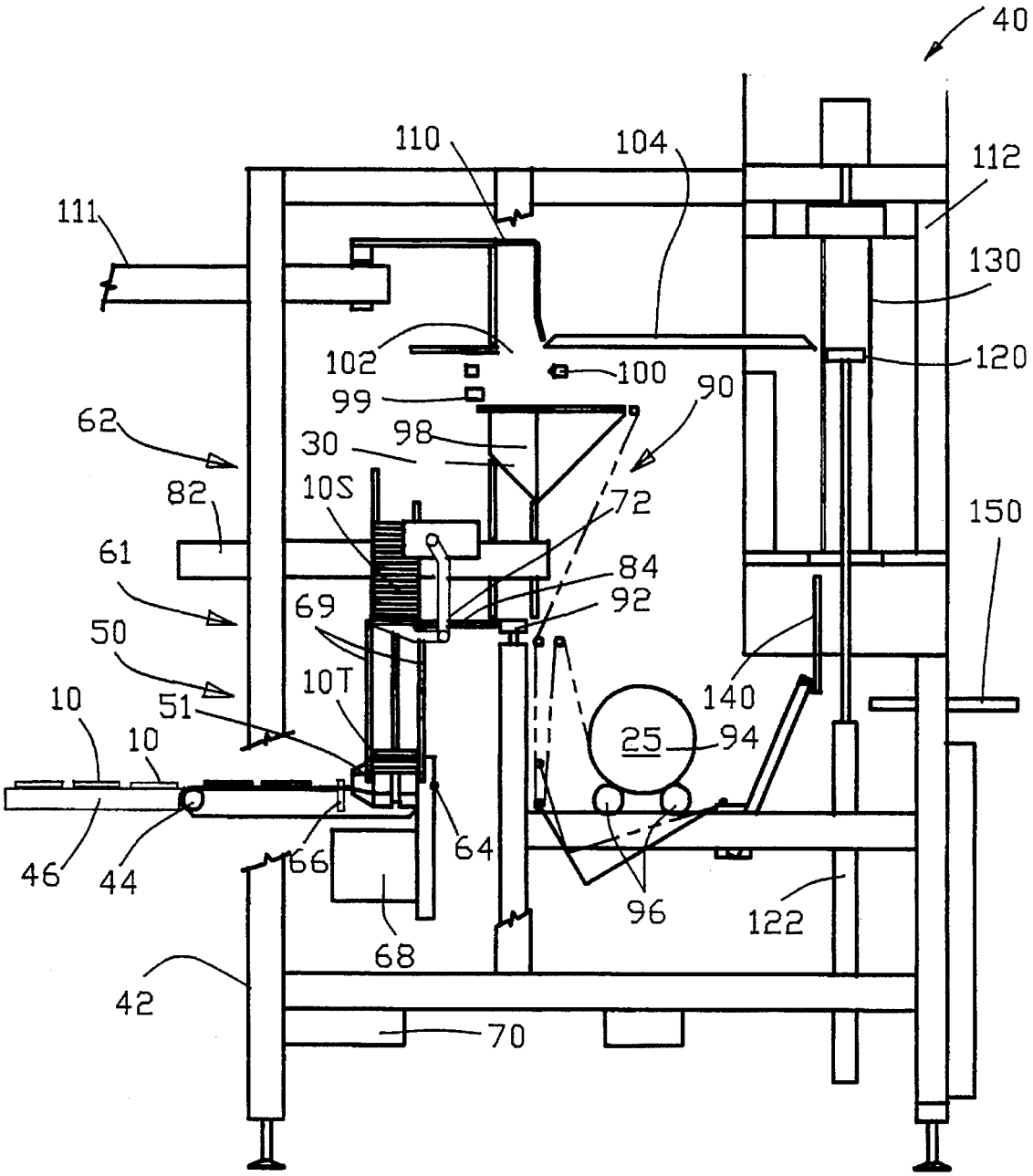
FIG. 23 is a front elevational view similar to FIG. 9 illustrating the first stage of transferring the stack of flat objects to the wrapper.

FIG. 23 is a front elevational view similar to FIG. 9 illustrating the first stage of transferring the stack of flat objects 10S to the wrapper 90 as shown in FIG. 20. The stack of flat objects 10S is shown raised by the first wrapper transport 61 into an elevated position. A second stack of flat objects 10T is shown being assembled in the stacker 50.

Figure 24:
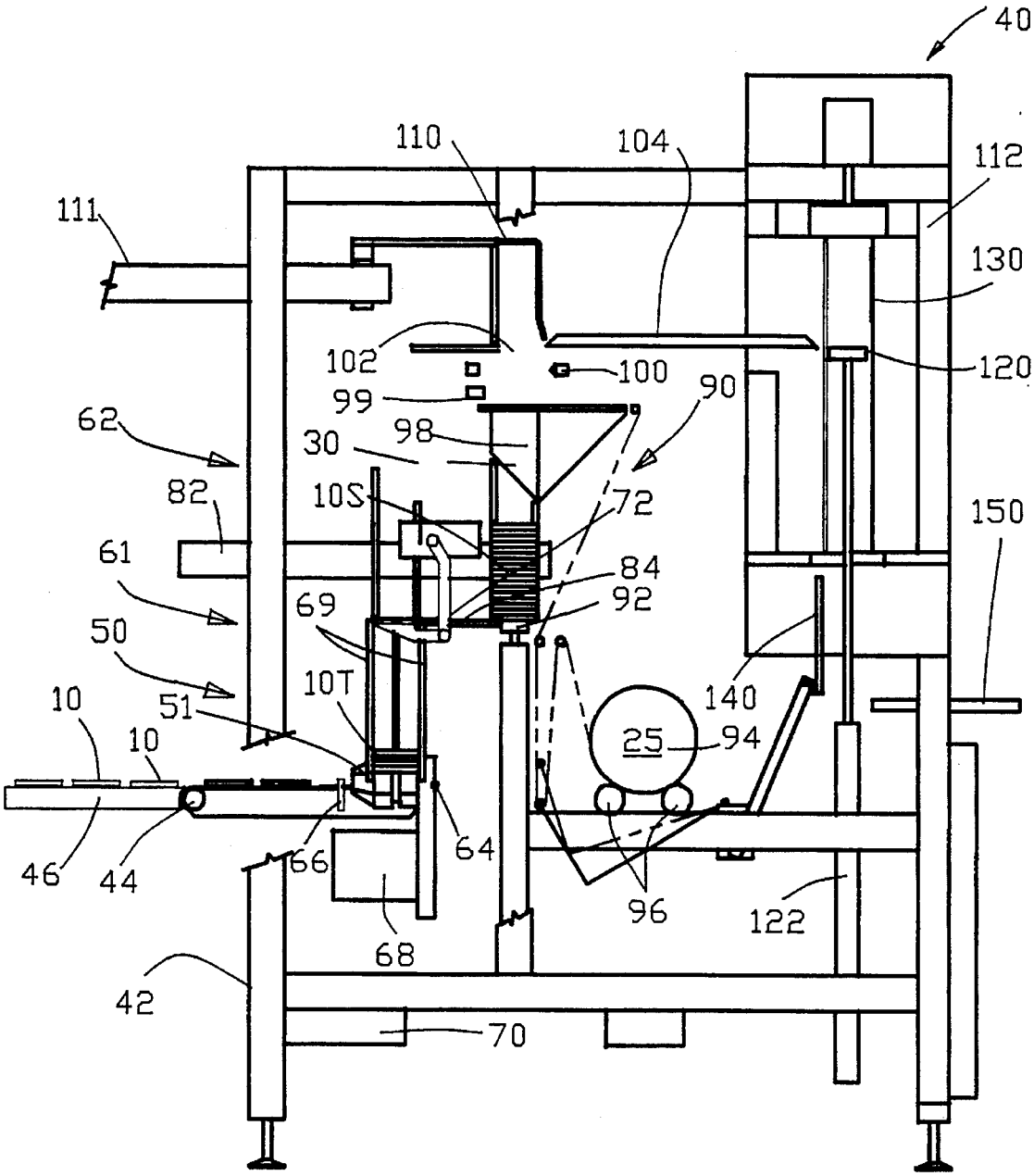
FIG. 24 is a front elevational view illustrating the second stage of transferring the stack of flat objects to a wrapper.

FIG. 24 is a front elevational view illustrating the second stage of transferring the stack of flat objects 10S by the pneumatically operated pusher 82 for pushing the stack of flat objects 10S along the slide 84 to the wrapper 90 ms shown in FIG. 21.

Figure 25:
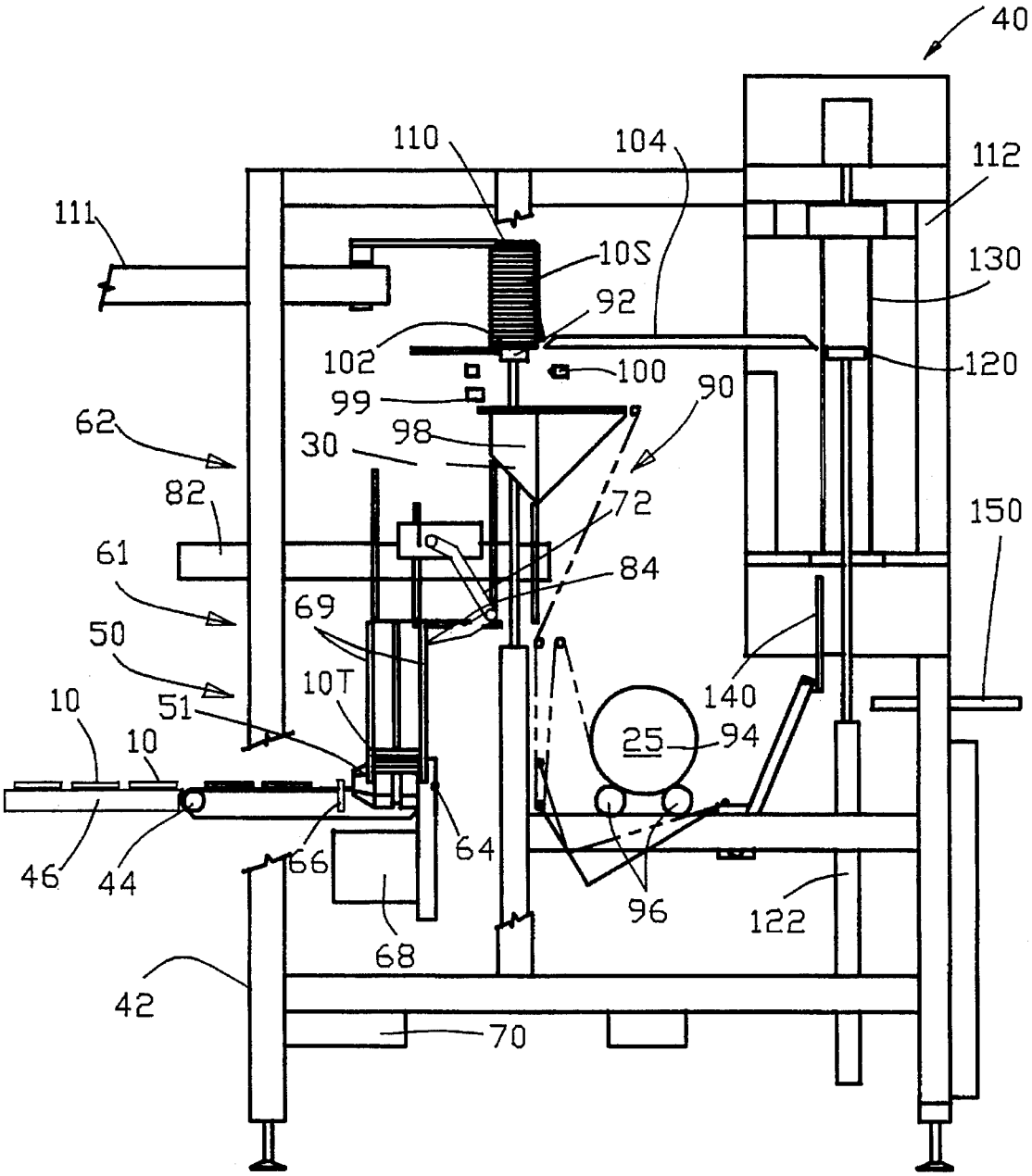
FIG. 25 is a front elevational view illustrating the movement of a wrapper driver for forming a film tube with the stack of flat objects disposed therein.

FIG. 25 is a front elevational view illustrating the movement of a wrapper driver 92 for forming a film tube 30 from the heat shrinkable material 25 with the stack of flat objects 10S disposed therein. The wrapper 90 comprises a spool 94 of the heat shrinkable material 25 supported by a holder 96 for threading the heat shrinkable material 25 through a plurality of guides to a forming tool 98 for forming the film tube 30. The forming tool 98 overlaps the first and second edges 28 and 29 of the heat shrinkable material 25 as shown in FIGS. 3–8 to form the longitudinally extending film tube 30. An electrostatic generator 99 is disposed proximate the forming tool 98 for creating an electrostatic seam along the first and second edges 28 and 29 of the film tube 30. In the alternative, a heat sealing seam (not shown) may be formed between the first and second edges 28 and 29 of the film tube 30. A reciprocally acting seal bar 100 seals the film tube 30 for forming the first end 21 of the heat shrink package 20.

The wrapper driver 92 vertically raises the stack of flat objects 10S through the forming tool 98 to insert the stack of flat objects 10S within the film tube 30. Continued movement of the wrapper driver 92 elevates the stack of flat objects 10S within the film tube 30 through scissor doors 101 and 102 shown best in FIG. 10 to an oven slide 104. The scissor doors 101 and 102 respectively pivot upon pivots 105 and 106 and define a central aperture 107.

The stack of flat objects 10S within the film tube 30 are driven through the open scissor doors 101 and 102 and the scissor doors 101 and 102 pivot upon pivots 105 and 106 to a closed position. The central aperture 107 allows the wrapper driver 92 to withdraw through the central aperture 107 to be retracted to the initial position shown in FIG. 24 while the scissor doors 101 and 102 support the stack of flat objects 10S. Thereafter, the sealer bar 100 seals the second end 27 of the film tube 30 to form the second end of the heat shrink package 20.

Figure 26:
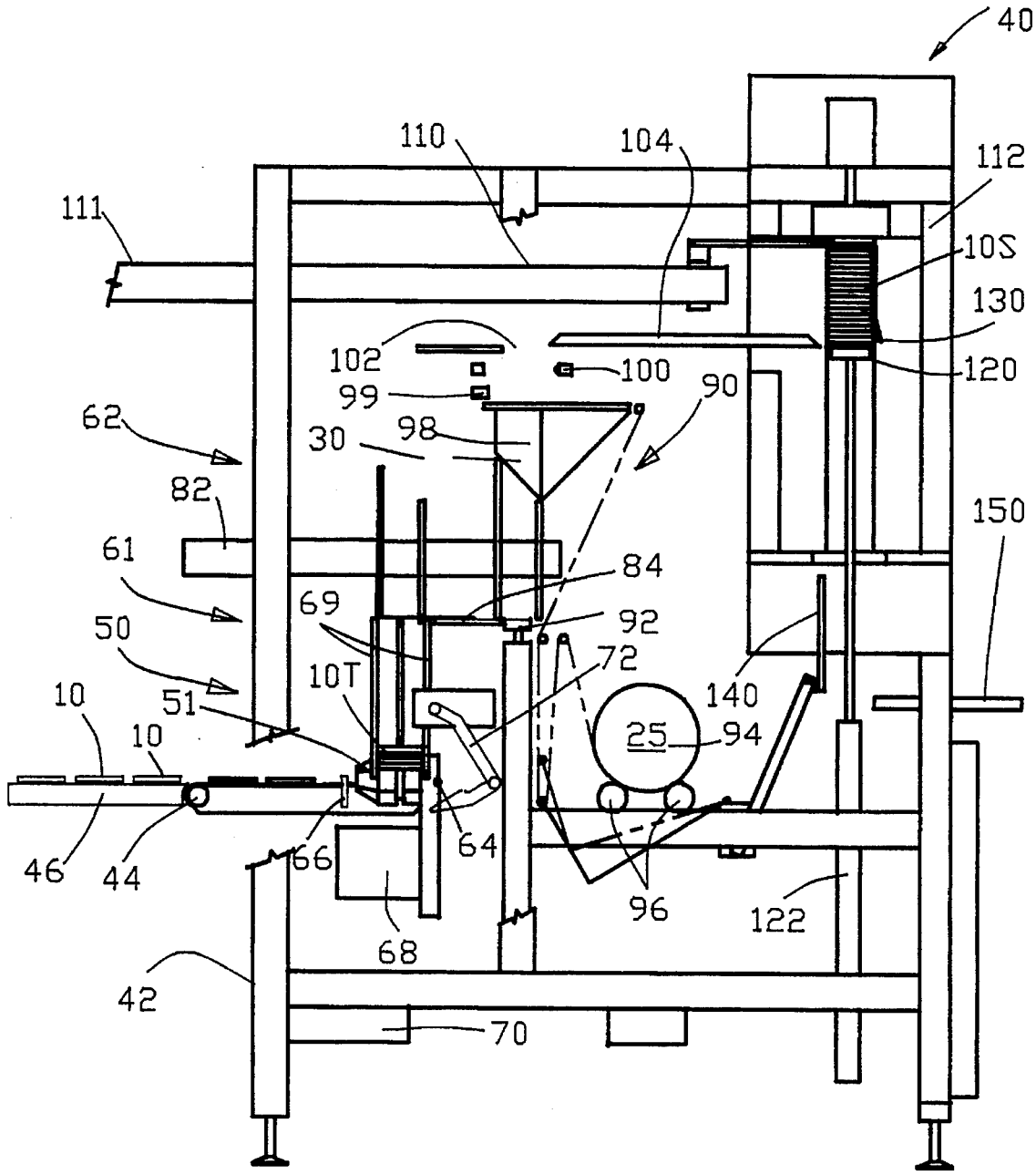
FIG. 26 is a front elevational view illustrating the movement of an input oven transport transferring the stack of flat objects to a heat shrink oven.

FIG. 26 is a front elevational view illustrating the movement of an input oven transport 110 moved by an air cylinder 111 for transferring the stack of flat objects 10S within the film tube 30 on the oven slide 104 into a heat shrink oven 112. The input oven transport 110 moves the stack of flat objects 10S within the film tube 30 onto an oven conveyor 120 disposed within the heat shrink oven 112. The oven conveyor 120 comprises a vertical elevator controlled by an air cylinder 122 or the like.

Figure 27:
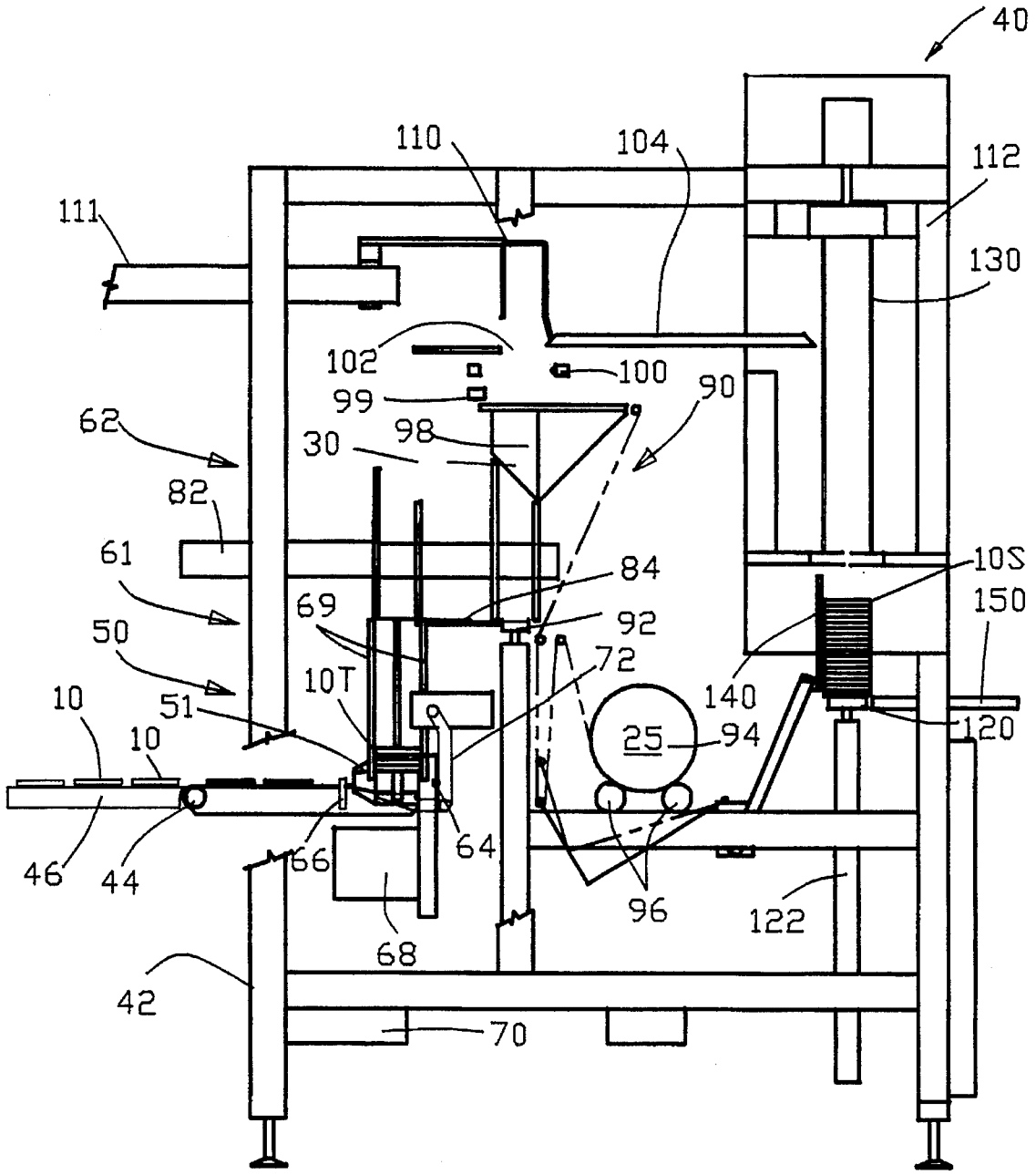
FIG. 27 is a front elevational view illustrating the movement of an oven conveyor moving the stack of flat objects through a heat shrink oven.

FIG. 27 is a front elevational view illustrating the movement of the oven conveyor 120 moving the stack of flat objects 10S within the film tube 30 through the heat shrink oven 112. The oven conveyor 120 linearly lowers the stack of flat objects 10S within the film tube 30 through the heat shrink oven 112 to a lower position as shown in FIG. 27. The linear motion of the oven conveyor 120 heats the film tube 30 to form the heat shrink package 20 shown in FIGS. 3–8. The linear motion of the oven conveyor 120 may be accurately controlled, thereby subjecting the film tube 30 and the stack of flat objects 10S to only a sufficient amount of heat to form the heat shrink package 20 while being insufficient to deteriorate the stack of flat objects 10S. When the stack of flat objects 10S are perishable food products such as hamburger patties and the like, the accuracy of the oven conveyor 120 insures that the food products are not unduly subjected to excessive heat to maintain the quality and wholesomeness of the food product.

Optional guide tubes 130 are located adjacent the oven conveyor 120 for supporting and maintaining alignment of the stack of flat objects 10S within the film tube 30 while the oven conveyor 120 linearly lowers the stack of flat objects 10S through the heat shrink oven 112. Preferably, the guide tubes 130 transport a flow of fluid such as a cooling liquid or a cooling gas for cooling the guide tubes 130. The cooling of the guide tubes 130 prevent the heat shrinkable material 25 from adhering to the guide tubes 130 when the stack of flat objects 10S is passed through the heat shrink oven 112.

Figure 28:
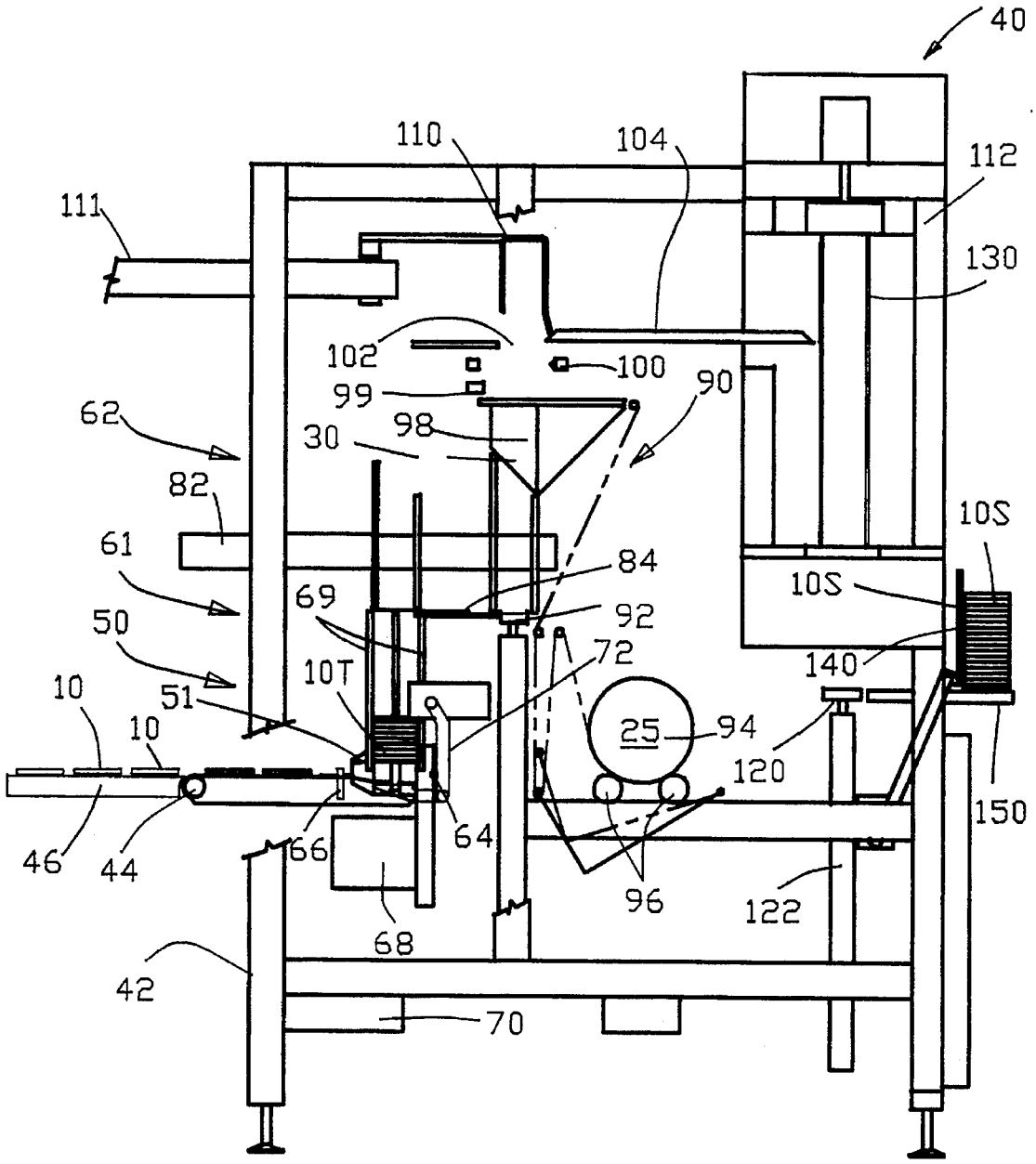
FIG. 28 is a front elevational view illustrating the movement of an output oven transport transferring the stack of flat objects to an output conveyor.

FIG. 28 is a front elevational view illustrating the movement of an output oven transport 140 transferring the heat shrink package 20 to an output conveyor 150. The output oven transport 140 shown as an air cylinder transfers the heat shrink package 20 to an output conveyor 150. The output conveyor 150 is disposed horizontally for interfacing with a carton machine or the like wherein the shrink wrap packages 20 may be automatically inserted within a cardboard shipping container or the like.

The improved shrink wrap packaging machine provides a package for a plurality of stackable items such as food products such as hamburger patties, fish patties, rice cakes, potato patties and the like as well as non-food products such as compact and floppy disks, cassettes, books, as well as other flat objects. The improved shrink wrap packaging machine controls the process time through the heat shrink oven to insure that frozen items are not overly heated to prevent degenerating the flavor of the frozen hamburger patty. The improved shrink wrap packaging machine provides a reliable and sanitary means for shrink wrap packaging of food products. Since the flat objects are packaged in a shrink wrap package, the need for wax impregnated cardboard containers is eliminated by this invention. Wax impregnated cardboard containers is not biodegradable and is not recyclable in contrast to the heat shrink film which is recyclable.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A shrink wrap package for a stack of flat objects, comprising in combination:

a longitudinally extending sheet of heat shrinkable film having a first and a second sheet end and a first and a second sheet edge;

said longitudinally extending sheet of heat shrinkable material being formed into a film tube with said first sheet edge overlapping said second sheet edge;

said first and second sheet ends being heat sealed for forming a heat shrink package having a first and a second package end;

an electrostatic seal for sealing said first sheet edge to said second sheet edge with the stack of flat objects being encased therein; and said electrostatic seal enabling an operator to twist said first package end relative to said second package end to fracture said electrostatic seal for removing the stack of flat objects from said heat shrunk package.

2. A shrink wrap package as set forth in claim 1, wherein said electrostatic seal extends longitudinally between said first package end relative to said second package end.

3. A shrink wrap package as set forth in claim 1, wherein said electrostatic seal extends longitudinally between said first package end relative to said second package end; and a heat seal interposed in a portion of said electrostatic seal between said first package end relative to said second package end.

* * * * *